US011821633B2

(12) United States Patent
Funk et al.

(10) Patent No.: US 11,821,633 B2
(45) Date of Patent: Nov. 21, 2023

(54) OVER-THE-RANGE MICROWAVE INCLUDING AIRFLOW REGULATING FEATURES

(71) Applicant: Haier US Appliance Solutions, Inc., Wilmington, DE (US)

(72) Inventors: Michael A. Funk, Louisville, KY (US); Michael Blackwood, Louisville, KY (US)

(73) Assignee: HAIER US APPLIANCE SOLUTIONS, INC., Wilmington, DE (US)

( * ) Notice: Subject to any disclaimer, the term of this patent is extended or adjusted under 35 U.S.C. 154(b) by 366 days.

(21) Appl. No.: 16/937,755

(22) Filed: Jul. 24, 2020

(65) Prior Publication Data

US 2022/0026074 A1 Jan. 27, 2022

(51) Int. Cl.

| | |
|---|---|
| ***F24C 15/20*** | (2006.01) |
| ***F24C 15/30*** | (2006.01) |
| ***H05B 6/64*** | (2006.01) |

(52) U.S. Cl.

CPC ..... *F24C 15/2028* (2013.01); *F24C 15/30* (2013.01); *H05B 6/6414* (2013.01); *H05B 6/6435* (2013.01)

(58) Field of Classification Search

CPC ..... F24C 7/02; F24C 15/02; H05B 6/6414; H05B 6/6423; H05B 6/6435

See application file for complete search history.

(56) References Cited

U.S. PATENT DOCUMENTS

| | | | | |
|---|---|---|---|---|
| 6,621,058 | B1 | 9/2003 | Kim | |
| 7,098,432 | B2 | 8/2006 | Rew et al. | |
| 7,183,529 | B2 | 2/2007 | Baek et al. | |
| 7,348,527 | B2 | 3/2008 | Braunisch et al. | |
| 8,074,637 | B2 | 12/2011 | Yamauchi | |
| 8,711,321 | B2 | 4/2014 | Dunn et al. | |
| 10,197,290 | B2 | 2/2019 | Lee | |
| 10,212,845 | B2 | 2/2019 | Azevedo | |
| 2008/0102743 | A1 | 5/2008 | Williams | |
| 2009/0134155 | A1* | 5/2009 | Kim | H05B 6/6402 219/757 |
| 2017/0064777 | A1* | 3/2017 | Joo | H05B 6/6402 |

(Continued)

FOREIGN PATENT DOCUMENTS

| | | |
|---|---|---|
| CN | 2513031 Y | 9/2002 |
| CN | 1278074 C | 10/2006 |

(Continued)

*Primary Examiner* — Thien S Tran

(74) *Attorney, Agent, or Firm* — Dority & Manning, P.A.

(57) ABSTRACT

A door assembly for a microwave appliance includes a door frame that defines a door plenum and an air inlet. A monitor cradle is positioned toward a front of the door frame for receiving an image monitor seated on top of or flush with a front of the door frame. A duct is mounted to the door frame to divide the plenum into a low pressure region and a high pressure region, and an air handler urges a flow of air through the door plenum. A trim piece is removably mounted to a top of the door frame and includes a front guide that is spaced apart from the image monitor to define an upper outlet through which the flow of air passes downward along the vertical direction in front of the image monitor.

17 Claims, 11 Drawing Sheets

(56) References Cited

U.S. PATENT DOCUMENTS

| | | | | |
|---|---|---|---|---|
| 2018/0372331 | A1 | 12/2018 | Serabatir et al. | |
| 2019/0316780 | A1 | 10/2019 | Seungtae | |
| 2019/0380230 | A1 | 12/2019 | Armstrong | |
| 2020/0056790 | A1 | 2/2020 | Armstrong | |
| 2020/0217513 | A1* | 7/2020 | Clayton | G06V 40/20 |
| 2021/0289593 | A1* | 9/2021 | Lee | F24C 15/006 |

FOREIGN PATENT DOCUMENTS

| | | | | |
|---|---|---|---|---|
| CN | 205402847 | U | | 7/2016 |
| CN | 108852030 | A | * | 11/2018 |
| JP | 6596252 | B2 | | 10/2019 |
| WO | WO2017134213 | A1 | | 8/2017 |
| WO | WO2019167639 | A1 | | 9/2019 |

* cited by examiner

OVER-THE-RANGE MICROWAVE INCLUDING AIRFLOW REGULATING FEATURES

FIELD OF THE INVENTION

The present subject matter relates generally to microwave appliances, and more particularly to an over-the-range microwave appliance mountable over a cooktop or range and having features for managing airflows through the microwave appliance.

BACKGROUND OF THE INVENTION

Cooktop or range appliances generally include heating elements for heating cooking utensils, such as pots, pans, and griddles. A variety of configurations can be used for the heating elements located on the cooking surface of the cooktop. The number of heating elements or positions available for heating on the cooktop can include, for example, four, six, or more depending upon the intended application and preferences of the buyer. These heating elements can vary in size, location, and capability across the appliance.

Often, a separate appliance, such as a microwave oven appliance (i.e., microwave appliance), is mounted directly above a cooktop or range appliance. Microwave appliances configured for this arrangement are generally referred to as over-the-range (OTR) microwave appliances. OTR microwave appliances (i.e., OTR microwaves) have become especially popular in consumer homes, apartments, and other residential settings. As with other microwave appliances, OTR microwave appliances generally include a cabinet that defines a cooking chamber for receipt of food items for cooking. In order to provide selective access to the cooking chamber and to contain food particles and cooking energy (e.g. microwaves) during a cooking operation, a door is further included that is typically pivotally mounted to the cabinet. Unlike other microwave appliances, though, OTR microwave appliances must often contend with heat and exhaust (e.g., steam, smoke, etc.) generated by the cooktop or range appliance mounted below the OTR microwave appliance. Some existing OTR microwave appliances have vent system for directing or motivating exhaust through the cabinet (e.g., around the cooking chamber) and out of an air outlet defined by an outer wall of the cabinet.

Nonetheless, existing systems leave much to be desired. In particular, the extreme environment near a cooktop appliance may risk damaging or impeding the use of an OTR microwave appliance. In some instances, a portion of the door or a user interface of an OTR microwave appliance may be rendered unusable. For instance, food or fluid (e.g., heated air or steam) may obscure the door or user interface. In some cases, the area through the door or the user interface may be partially or completely blocked from view. In other cases, heat or exhaust fumes may be directed to the user interface or controller of the OTR microwave appliance, increasing the potential failure of the OTR appliance. Moreover, heat from the cooktop appliance may be directed at or absorbed by the door (e.g., at a door handle) of the OTR microwave appliance, which may damage the door or make it difficult for a user to access the door.

Accordingly, an OTR microwave with improved heat regulation and airflow features would be desirable. More specifically, an airflow regulation system for an OTR microwave appliance that protects the door, the user interface, or one or more electronic components from the extreme environment near or above a cooktop appliance would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a microwave appliance mountable over a cooktop appliance is provided. The microwave appliance defines a vertical direction, a lateral direction, and a transverse direction, and includes a cabinet defining a cooking chamber and a door assembly rotatably mounted to the cabinet for providing selective access to the cooking chamber. The door assembly includes a door frame defining a door plenum and an air inlet, a monitor cradle mounted to a front of the door frame, an image monitor mounted within the monitor cradle, an air handler positioned within the door frame for urging a flow of air through the door plenum, and a trim piece removably mounted to a top of the door frame, wherein the trim piece includes a front guide that is spaced apart from the image monitor along the transverse direction to define an upper outlet that directs the flow of air downward along the vertical direction in front of the image monitor.

In another exemplary embodiment, a door assembly for a microwave appliance is provided. The microwave appliance is mountable over a cooktop appliance and includes a cabinet defining a cooking chamber. The door assembly includes a door frame defining a door plenum and an air inlet, a monitor cradle mounted to a front of the door frame, an image monitor mounted within the monitor cradle, an air handler positioned within the door frame for urging a flow of air through the door plenum, and a trim piece removably mounted to a top of the door frame, wherein the trim piece includes a front guide that is spaced apart from the image monitor along the transverse direction to define an upper outlet that directs the flow of air downward along the vertical direction in front of the image monitor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
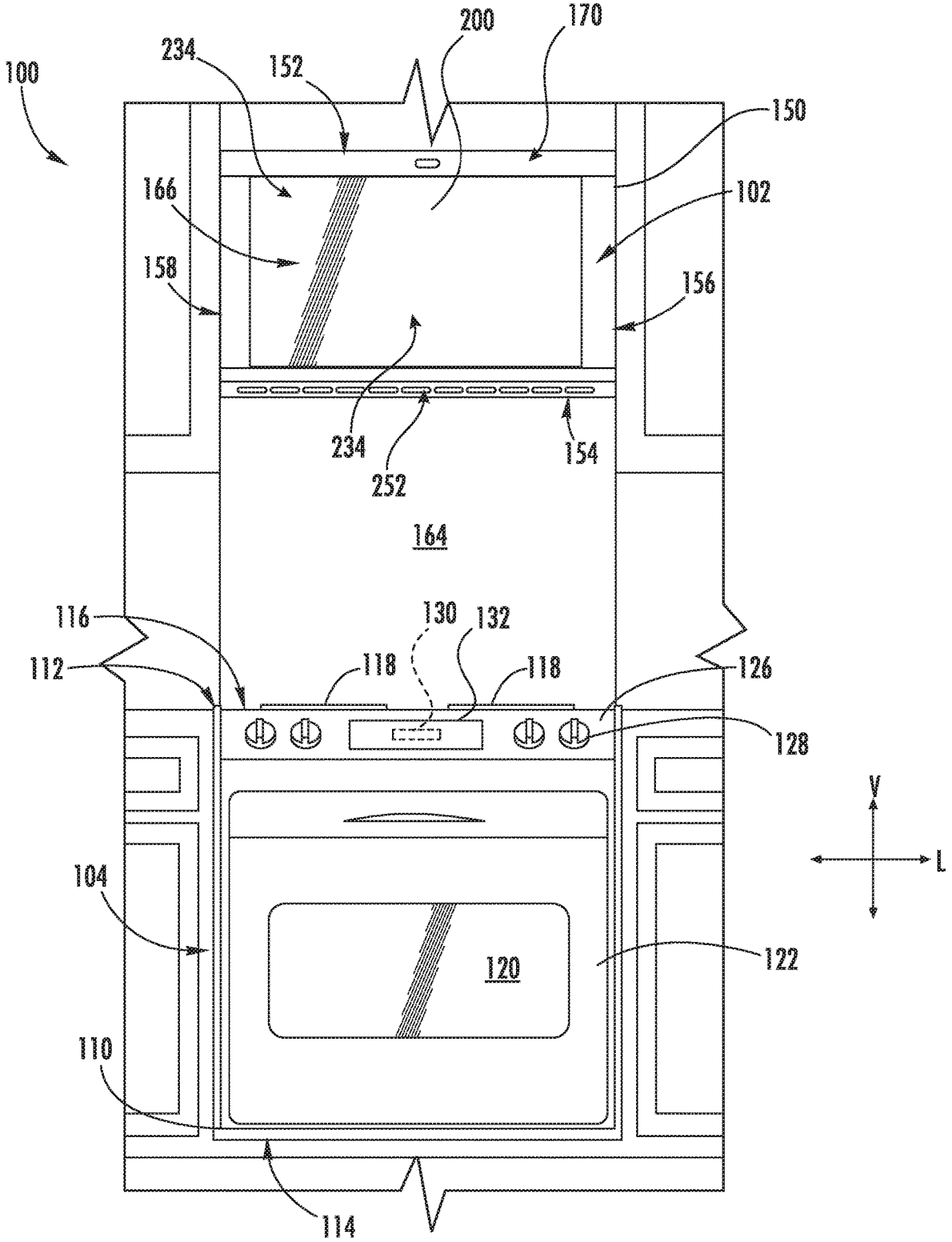
FIG. 1 provides a front view of a system, including a microwave appliance, according to exemplary embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
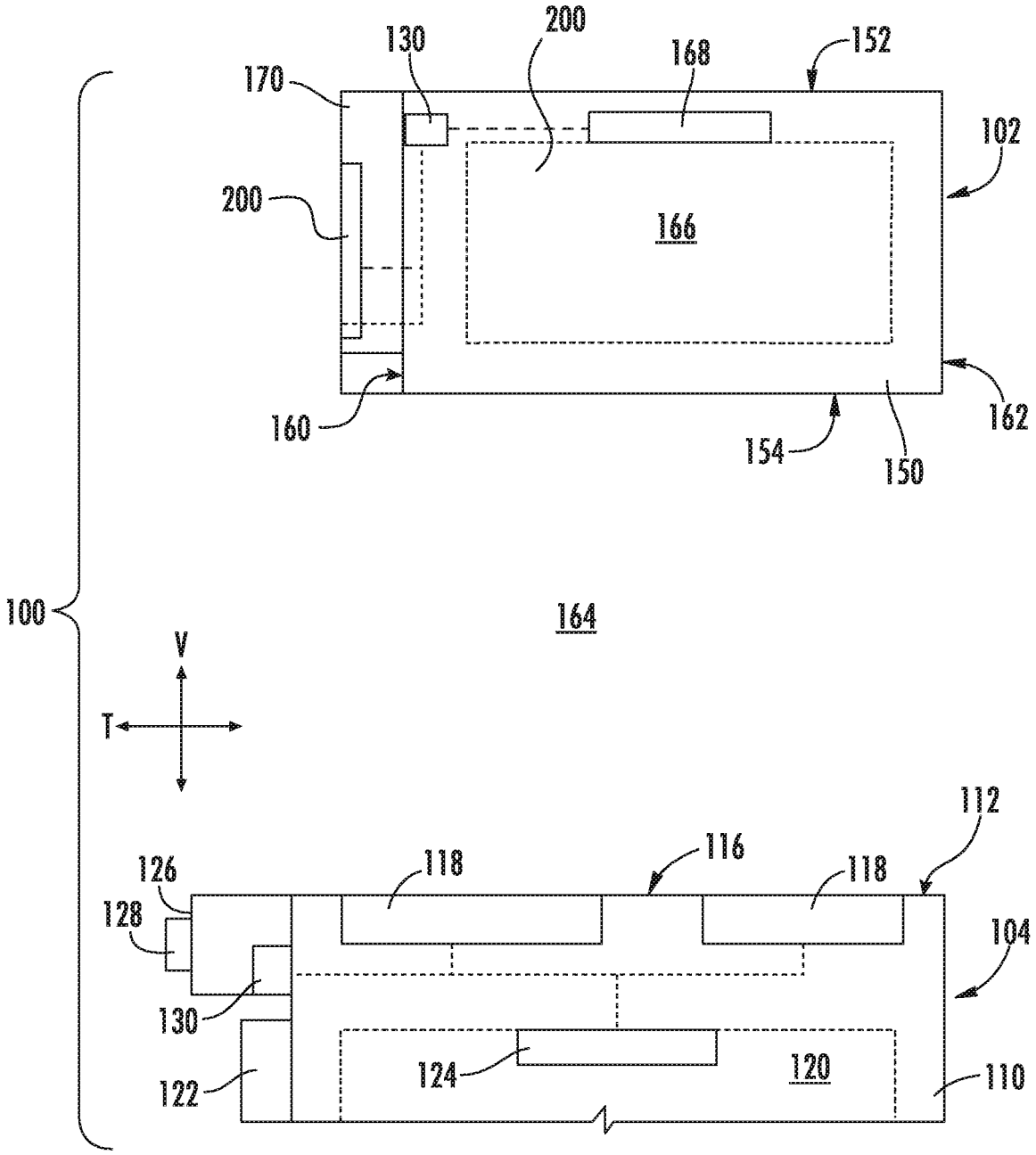
FIG. 2 provides a side schematic view of the exemplary system of FIG. 1.
Figure 3:
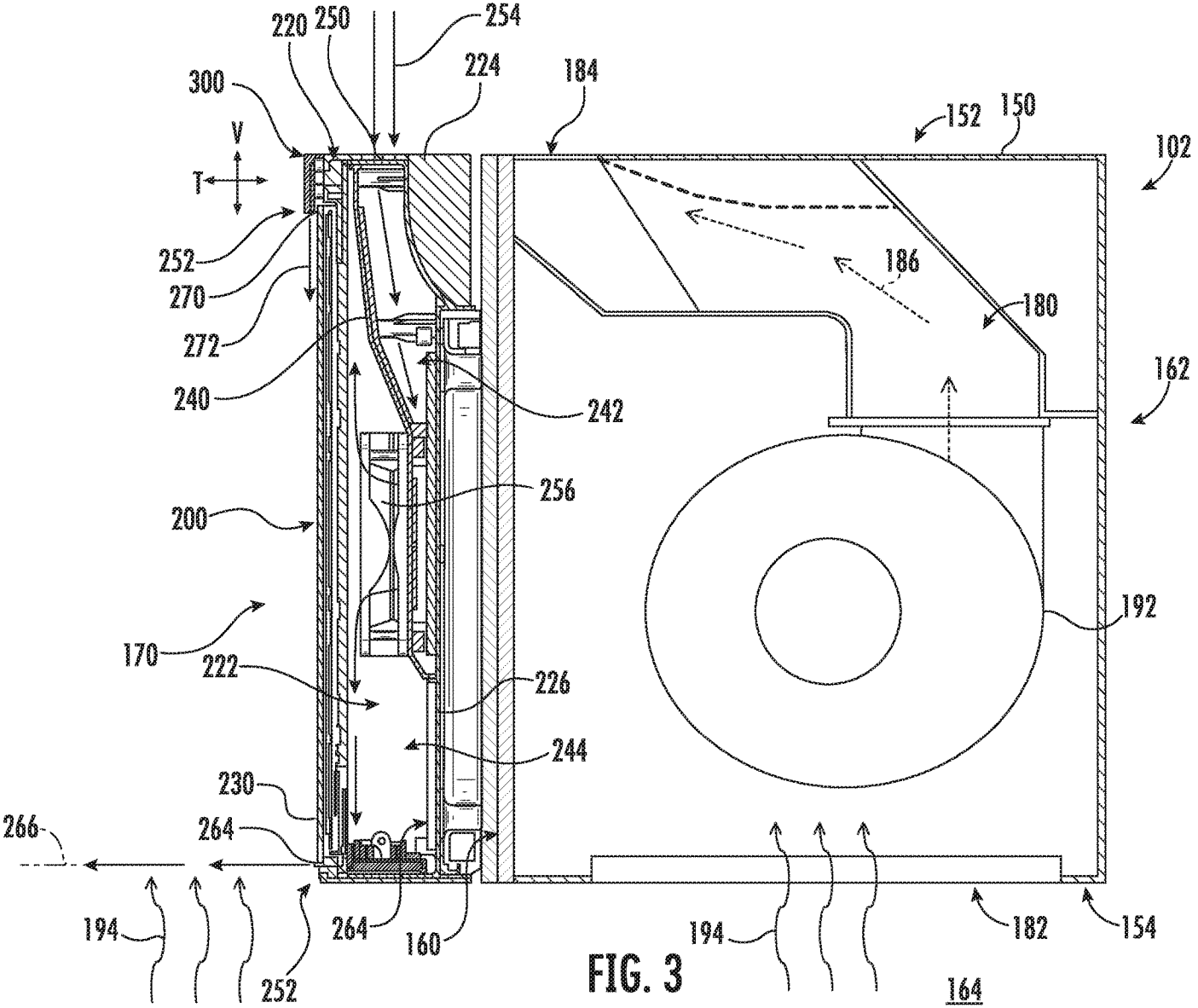
FIG. 3 provides a cross-sectional schematic view of the exemplary microwave appliance of FIG. 1 according to exemplary embodiments of the present disclosure.

Turning to the figures, FIGS. 1 through 3 provide various views of a system 100 according to exemplary embodiments of the present disclosure. System 100 generally includes an over-the-range (OTR) microwave appliance 102 that can be positioned or mounted above a cooktop appliance 104. Each of these appliances 102, 104 within system 100 will be described independently and collectively below. However, it should be appreciated that the present subject matter is not limited to the specific appliances disclosed, and the specific appliance configurations are not intended to limit the scope of the present subject matter in any manner.

As shown in FIGS. 1 and 2, system 100 defines a vertical direction V, a lateral direction L, and a transverse direction T. The vertical, lateral, and transverse directions are mutually perpendicular and form an orthogonal direction system. As used herein, this coordinate system applies equally to both microwave appliance 102 and cooktop appliance 104 and will thus be used interchangeably to describe both appliances and their positions relative to each other.

Cooktop appliance 104 can include a chassis or cabinet 110 that extends along the vertical direction V between a top portion 112 and a bottom portion 114; along the lateral direction L between a left side portion and a right side portion; and along the traverse direction T between a front portion and a rear portion. Cooktop appliance 104 includes a cooktop surface 116 having one or more heating elements 118 for use in, for example, heating or cooking operations. In exemplary embodiments, cooktop surface 116 is constructed with ceramic glass. In other embodiments, however, cooktop surface 116 may include of another suitable material, such as a metallic material (e.g., steel) or another suitable non-metallic material. Heating elements 118 may be various sizes and may employ any suitable method for heating or cooking an object, such as a cooking utensil (not shown), and its contents. In some embodiments, for example, heating element 118 uses a heat transfer method, such as electric coils or gas burners, to heat the cooking utensil. In other embodiments, however, heating element 118 uses an induction heating method to heat the cooking utensil directly. In turn, heating element 118 may include a gas burner element, resistive heat element, radiant heat element, induction element, or another suitable heating element.

In some embodiments, cooktop appliance 104 includes an insulated cabinet 110 that defines a cooking chamber 120 selectively covered by a door 122. One or more heating elements 124 (e.g., top broiling elements or bottom baking elements) may be enclosed within cabinet 110 to heat cooking chamber 120. Heating elements 124 within cooking chamber 120 may be provided as any suitable element for cooking the contents of cooking chamber 120, such as an electric resistive heating element, a gas burner, a microwave element, a halogen element, etc. Thus, cooktop appliance 104 may be referred to as an oven range appliance. As will be understood by those skilled in the art, cooktop appliance 104 is provided by way of example only, and the present subject matter may be used in the context of any suitable cooking appliance, such as a double oven range appliance or a standalone cooktop (e.g., fitted integrally with a surface of a kitchen counter). Thus, the example embodiments illustrated in figures are not intended to limit the present subject matter to any particular cooking chamber or heating element configuration, except as otherwise indicated.

As illustrated, a user interface panel 126 may be provided on cooktop appliance 104. Although shown at front portion of cooktop appliance 104, another suitable location or structure (e.g., a backsplash) for supporting user interface panel 126 may be provided in alternative embodiments. In some embodiments, user interface panel 126 includes input components or controls 128, such as one or more of a variety of electrical, mechanical, or electro-mechanical input devices. Controls 128 may include, for example, rotary dials, knobs, push buttons, and touch pads. A controller 130 is in communication with user interface panel 126 and controls 128 through which a user may select various operational features and modes and monitor progress of cooktop appliance 104.

In additional or alternative embodiments, user interface panel 126 includes a display component 132, such as a digital or analog display in communication with a controller 130 and configured to provide operational feedback to a user. In certain embodiments, user interface panel 126 represents a general purpose I/O ("GPIO") device or functional block.

As shown, controller 130 is communicatively coupled (i.e., in operative communication) with user interface panel 126, controls 128, and display 132. Controller 130 may also be communicatively coupled with various operational components of cooktop appliance 104 as well, such as heating elements (e.g., 118, 124), sensors, etc. Input/output ("I/O") signals may be routed between controller 130 and the various operational components of cooktop appliance 104. Thus, controller 130 can selectively activate and operate these various components. Various components of cooktop appliance 104 are communicatively coupled with controller 130 via one or more communication lines such as, for example, conductive signal lines, shared communication busses, or wireless communications bands.

In some embodiments, controller 130 includes one or more memory devices and one or more processors. The processors can be any combination of general or special purpose processors, CPUs, or the like that can execute programming instructions or control code associated with operation of cooktop appliance 104. The memory devices (i.e., memory) may represent random access memory such as DRAM or read only memory such as ROM or FLASH. In one embodiment, the processor executes programming instructions stored in memory. The memory may be a separate component from the processor or may be included onboard within the processor. Alternatively, controller 130 may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, controller 130 includes a network interface such that controller 130 can connect to and communicate over one or more networks with one or more network nodes. Controller 130 can also include one or more transmitting, receiving, or transceiving components for transmitting/receiving communications with other devices communicatively coupled with cooktop appliance 104. Additionally, or alternatively, one or more transmitting, receiving, or transceiving components can be located off board controller 130. Generally, controller 130 can be positioned in any suitable location throughout cooktop appliance 104. For example, controller 130 may be located proximate user interface panel 126 toward front portion of cooktop appliance 104. In optional embodiments, controller 130 is in operable communication with a controller 130 (described below) of microwave appliance 102 (e.g., through one or more wired or wireless channels).

As noted above, microwave appliance 102 may be positioned or mounted above cooktop appliance 104 (e.g., as an OTR microwave). Specifically, an insulated cabinet 150 of microwave appliance 102 may be positioned above cooktop appliance 104 along the vertical direction V. As shown, cabinet 150 of microwave appliance 102 includes a plurality of outer walls and when assembled, microwave appliance 102 generally extends along the vertical direction V between a top end 152 and a bottom end 154; along the lateral direction L between a first side end 156 and a second side end 158; and along the transverse direction T between a front end 160 and a rear end 162. In some embodiments, cabinet 150 is spaced apart from cooktop surface 116 along the vertical direction V. An open region 164 may thus be defined along the vertical direction V between cooktop surface 116 and bottom end 154 of cabinet 150. Although a generally rectangular shape is illustrated, any suitable shape or style may be adapted to form the structure of cabinet 150. Within cabinet 150, an internal liner of cabinet 150 defines a cooking chamber 166 for receipt of food items for cooking.

Microwave appliance 102 is generally configured to heat articles (e.g., food or beverages) within cooking chamber 166 using electromagnetic radiation. Microwave appliance 102 may include various components which operate to produce the electromagnetic radiation, as is generally understood. For example, microwave appliance 102 may include a heating assembly 168 having a magnetron (e.g., a cavity magnetron), a high voltage transformer, a high voltage capacitor, and a high voltage diode, as is understood. The transformer may provide energy from a suitable energy source (such as an electrical outlet) to the magnetron. The magnetron may convert the energy to electromagnetic radiation, specifically microwave radiation. The capacitor generally connects the magnetron and transformer, such as via high voltage diode, to a chassis. Microwave radiation produced by the magnetron may be transmitted through a waveguide to cooking chamber 166.

The structure and intended function of microwave ovens or appliances are generally understood by those of ordinary skill in the art and are not described in further detail herein. According to alternative embodiments, microwave appliance 102 may include one or more heating elements, such as electric resistance heating elements, gas burners, other microwave heating elements, halogen heating elements, or suitable combinations thereof, are positioned within cooking chamber 166 for heating cooking chamber 166 and food items positioned therein.

Microwave appliance 102 includes a door assembly 170 that is movably mounted (e.g., rotatably attached) to cabinet 150 in order to permit selective access to cooking chamber 166. Specifically, door assembly 170 can move between an open position (not pictured) and a closed position (e.g., FIG. 1). The open position permits access to cooking chamber 166 while the closed position restricts access to cooking chamber 166. Except as otherwise indicated, with respect to the directions (e.g., the vertical direction V, the lateral direction L, and the transverse direction T), the door assembly 170 is described in the closed position. A handle 172 may be mounted to or formed on door assembly 170 (e.g., at a peripheral frame 224 of door assembly 170) to assist a user with opening and closing door assembly 170. As an example, a user can pull on handle 172 to open or close door assembly 170 and access or cover cooking chamber 166. Additionally, or alternatively, microwave appliance 102 may include a door release button (not pictured) that disengages or otherwise pushes open door assembly 170 when depressed.

Figure 4:
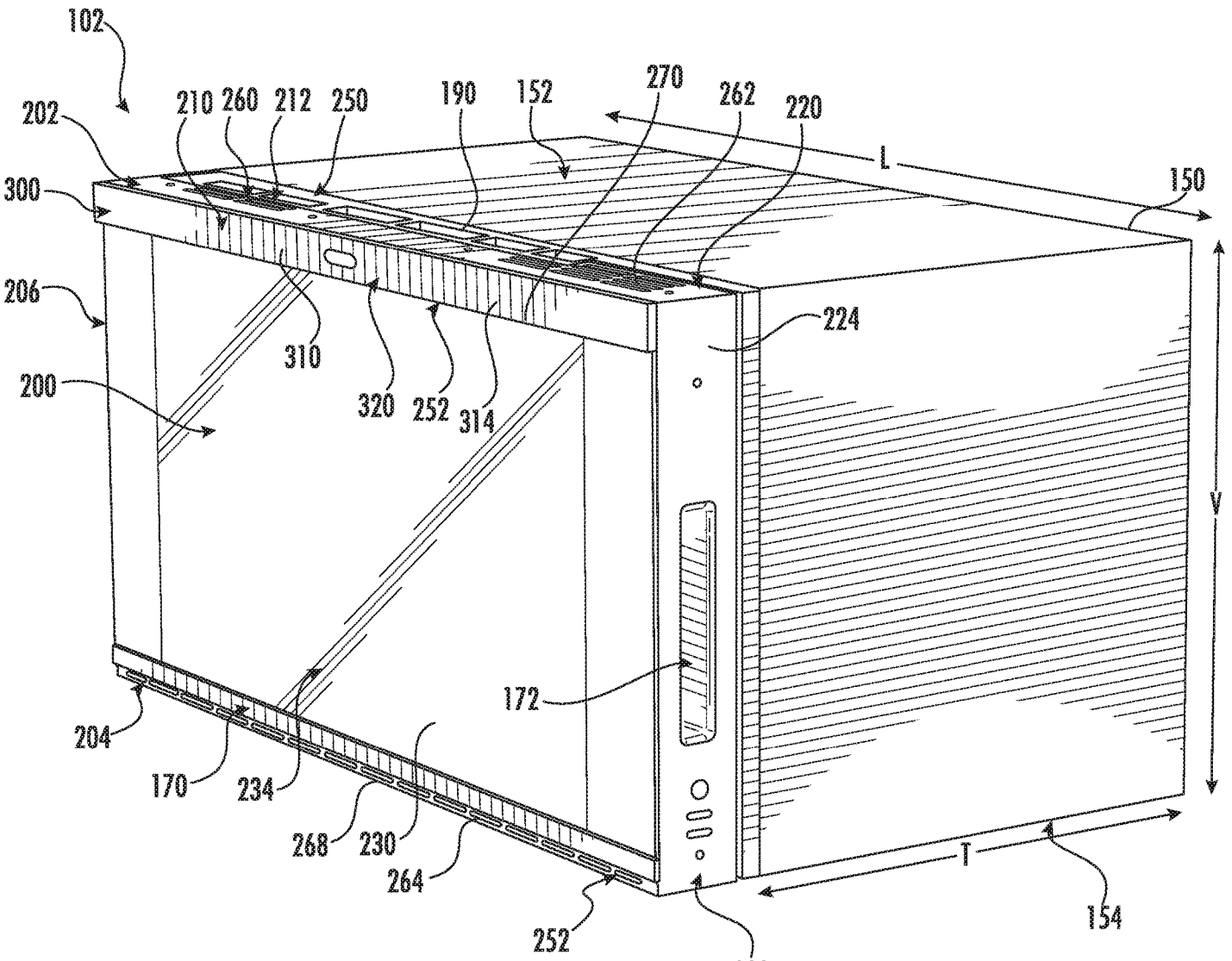
FIG. 4 provides a perspective view of the exemplary microwave appliance of FIG. 1 according to exemplary embodiments of the present disclosure.

Referring now briefly to FIGS. 3 and 4, in certain embodiments, an exhaust passage 180 is defined within cabinet 150. As shown, exhaust passage 180 may extend between an exhaust inlet 182 and an exhaust outlet 184 (e.g., through one or more external walls of cabinet 150) and may be in fluid isolation from door assembly 170. In some embodiments, exhaust inlet 182 is defined through cabinet 150 proximal to the bottom end 154 (e.g., through a bottom wall or directly above cooktop surface 116—FIG. 2). In additional or alternative embodiments, exhaust outlet 184 is defined through cabinet 150 proximal to the top end 152 (e.g., through a top wall of cabinet 150). Optionally, exhaust outlet 184 may include a plurality of exhaust apertures (FIG. 4). As explained in further detail below, according to an exemplary embodiment, exhaust outlet 184 may also be partially defined within door assembly 170.

According to exemplary embodiments, exhaust outlet 184 is positioned on top end 152 of cabinet 150 rearward from door assembly 170 along the transverse direction T. In this manner, a flow of exhaust air (identified herein generally by reference numeral 186) is discharged rearward of door assembly 170 along the transverse direction T. In addition, or alternatively, door assembly 170 may define a discharge scoop 188 and a door exhaust vent 190 that are in fluid communication with the exhaust passage 180. In this manner, the flow of exhaust air 186 may be directed past front end 160 of cabinet 150 where discharge scoop 188 directs the flow of exhaust air 186 up and away from microwave appliance 102. In addition, as best shown in FIG. 4, the exhaust passage 180 and/or discharge scoop 188 may be directed toward a center of door 150 along the lateral direction L. In this regard, at least a portion of exhaust passage 180 and/or discharge scoop 188 may be tapered downstream from exhaust air handler 192. This tapered or narrowed region of the exhaust path reduces the cross-sectional area of exhaust passage 180 and accelerates the flow rate of air or exhaust gases (e.g., at 186) upstream of exhaust outlet 184 such that the flow of exhaust air 186 is accelerated up and away from cabinet 150.

An exhaust air handler 192 may be mounted within exhaust passage 180. As would be understood, exhaust air handler 192 may be provided as any suitable blower or fan (e.g., radial fan, tangential fan, etc.) positioned within cabinet 150 to actively rotate or motivate air, steam, or exhaust fumes through exhaust passage 180. During use, the heat, steam, or exhaust fumes 194 may be motivated by exhaust air handler 192 from open region 164 (FIG. 2) to exhaust passage 180 through exhaust inlet 182 into exhaust outlet 184 (e.g., as indicated at arrows 186). Optionally, one or more filters (not pictured) may be provided at exhaust inlet 182 (e.g., between open region 164 and exhaust passage 180) to clean the air, steam, or exhaust fumes (e.g., at 194) as it enters cabinet 150. For instance, a grease filter having a suitable coarse filter medium, such as a metallic mesh including aluminum or stainless steel, may be mounted across exhaust inlet 182. Additionally, or alternatively, an odor filter having a suitable fine filter medium, such as a mesh or block including activated carbon, may be mounted across exhaust inlet 182. Optionally, the odor filter may be positioned above or downstream from the grease filter.

Referring now generally to FIGS. 1 through 11, microwave appliance 102 may include an interactive display assembly 200. According to the illustrated embodiment, interactive display 200 is mounted to or within a door assembly 170 and defines substantially the entire front surface of door assembly 170. In this regard, door assembly 170 generally extends between a top end 202 and a bottom end 204 along the vertical direction V, between a first side 206 and a second side 208 along the lateral direction L, and between a front side 210 and a rear side 212 along a transverse direction T. As illustrated, interactive display 200 extends along substantially the entire width of door assembly 170 along the lateral direction L (e.g., between the first side 206 and second side 208) and substantially along the entire height of door assembly 170 along the vertical direction V (e.g., between top end 202 and bottom end 204).

According to the illustrated embodiment, door assembly 170 includes a door frame 220 that bounds or supports interactive display 200. In addition, as illustrated, door frame 220 at least partially defines a door plenum 222, e.g., a void within door assembly 170 that may receive a flow of cooling air (as described in more detail below). Specifically, door frame 220 includes a peripheral frame 224 and a rear frame 226 that at least partially defines door plenum 222. In this regard, rear frame 226 may be a panel that extends in the vertical direction V and the lateral direction L for generally assisting with insulating cooking chamber 166 and defining a rear side of a door plenum 222. Peripheral frame 224 generally includes four sides that extend from a perimeter of rear frame 226 four and along the transverse direction T to define a perimeter boundary of door plenum 222.

According to the illustrated embodiment, interactive display 200 of door assembly 170 includes an image monitor 230 that is provided above cooktop surface 116 (e.g., along the vertical direction V). For instance, image monitor 230 may be mounted to or supported on door assembly 170 (e.g., directly above cooktop surface 116) proximal to the front side 210 of door assembly 170. Specifically, as illustrated, door assembly 170 may include a monitor cradle 232 is positioned proximate a front side 210 of door assembly 170 for securely receiving image monitor 230. Monitor cradle 232 may generally be any suitably rigid member mounted to door frame 220 for securing image monitor 230. As shown, monitor cradle 232 further defines a front side of door plenum 222.

Generally, image monitor 230 may be any suitable type of mechanism for visually presenting a digital (e.g., interactive) image. For example, image monitor 230 may be a liquid crystal display (LCD), a plasma display panel (PDP), a cathode ray tube (CRT) display, etc. Thus, image monitor 230 includes an imaging surface 234 (e.g., screen or display panel) at which the digital image is presented or displayed as an optically-viewable picture (e.g., static image or dynamic video) to a user. As illustrated, the imaging surface 234 generally faces, or is directed away from, cooktop surface 116. In particular, the imaging surface 234 is directed toward the area forward from the cooktop appliance 104 (e.g., when door assembly 170 is in the closed position). During use, a user standing in front of cooktop appliance 104 may thus see the optically-viewable picture (e.g., recipe, dynamic video stream, graphical user interface, etc.) displayed at the imaging surface 234.

The optically-viewable picture at the imaging surface 234 may correspond to any suitable signal or data received or stored by microwave appliance 102 (e.g., at controller 130). As an example, image monitor 230 may present recipe information in the form of viewable text or images. As another example, image monitor 230 may present a remotely captured image, such as a live (e.g., real-time) dynamic video stream received from a separate user or device. As yet another example, image monitor 230 may present a graphical user interface (GUI) (e.g., as part of user interface) that allows a user to select or manipulate various operational features of microwave appliance 102. During use of such GUI embodiments, a user may engage, select, or adjust the image presented at image monitor 230 through any suitable input, such as gesture controls detected through a camera assembly, voice controls detected through one or more microphones, associated touch panels (e.g., capacitance or resistance touch panels) or sensors overlaid across imaging surface 234, etc. According to the illustrated embodiment, image monitor 230 is a tablet or touch screen display that extends an entire width and height of door assembly 170 and provides for an interactive experience to the user of microwave appliance 102.

Similar to cooktop appliance 104, microwave appliance 102 may include a controller 130 that facilitates operation of microwave appliance 102. In addition, it should be appreciated that according to exemplary embodiments, in addition to image monitor 230, microwave appliance may further include an additional user interface panel (e.g., similar to user interface panel 126), user inputs (e.g., similar to user inputs 128), a controller (e.g., similar to controller 130), and/or additional displays (such as display 132). Controller 130 may be mounted within cabinet 150, may be mounted within or be a part of image monitor 230, or may be positioned and integrated in any other suitable manner. In some embodiments, cooktop controller 130 is provided as or as part of microwave controller 130. In alternative embodiments, cooktop controller 130 is a discrete unit in selective operable communication with microwave controller 130 (e.g., through one or more wired or wireless channels). A detailed description of such components is omitted here for brevity.

According to exemplary embodiments, image monitor 230 may be mounted within monitor cradle 232 such that image monitor 230 sits on top of or flush with door frame 220. In this regard, imaging surface 234 may extend the entire width and height of door assembly 170 and may provide a clean look and larger interactive surface for the consumer. According to still other embodiments, door frame 222 may be a thin frame that encases image monitor 230, e.g., such that a front end of image monitor 230 sits in the same transverse plane as a front end of door frame 220, e.g., flush with one another.

Referring now specifically to FIGS. 3 through 11, door assembly 170 may include variety of air flow regulation features for facilitating improved operation of microwave appliance 102. In this regard, for example, these air flow regulation features may be designed generally for cooling internal electronic components, for providing a flow of fresh air across image monitor 230, or for otherwise managing exhaust fumes 194. Although exemplary air flow regulation features are described below, it should be appreciated that variations and modifications may be made while remaining within the scope of the present subject matter.

As illustrated, door assembly 170 includes a duct 240 mounted to door frame 220 within door plenum 222. In general, duct 240 divides door plenum 222 into a low-pressure region 242 and a high-pressure region 244. Specifically, according to the illustrated embodiment, duct 240 is mounted to rear frame 226 and defines low-pressure region 242 between rear frame 226 and duct 240, while high-pressure region 244 is define between duct 240 and monitor cradle 232. Door frame 220 may further define one or more air inlets 250 and one or more air outlets 252 through which a flow of air (identified generally by reference numeral 254) may pass into and out of door plenum 222, respectively.

Door assembly 170 may further include one or more air handlers that are positioned within door plenum 222 or are otherwise in fluid communication with door plenum 222 for urging the flow of air 254 through door plenum 222. Specifically, according to the illustrated embodiment, door assembly 170 includes a plurality of axial fans 256 for generating airflow 254 within door plenum 222. In general, suitable air handlers more generally may be provided as any suitable blower or fan (e.g., radial fan, tangential fan, etc.) positioned within door assembly 170 to actively rotate or motivate air therethrough.

In general, air inlets 250 and air outlets 252 may be positioned at any suitable location or locations within door assembly 170 for drawing in and discharging the flow of air 254. According to the illustrated embodiment, air inlet 250 may be defined on top end 202 of door assembly 170, e.g., through peripheral frame 224. More specifically, air inlet 250 may be defined as apertures proximate lateral sides (e.g., proximate first side 206 and second side 208) of top end 202 peripheral frame 224. More specifically, air inlet 250 may include a first set of apertures 260 positioned proximate first side 206 and a second set of apertures 262 positioned proximate a second side 208 of peripheral frame 224. In this manner, peripheral frame 224 does not define an air inlet 250 proximate a center or midpoint along the lateral direction L. Notably, as explained above, discharge scoop 188 and door exhaust vent 190 may be tapered to direct the flow of exhaust air 186 out the center of door assembly 170, e.g., through peripheral frame 224. Therefore, by placing air inlets 250 on lateral sides of door frame 220, the flow of air 254 drawn into door plenum 222 may be substantially isolated from the discharge flow of exhaust air 186.

According to the illustrated embodiment, a first outlet of air outlets 252 includes a lower outlet 264 positioned below image monitor 230. In particular, lower outlet 264 is defined through peripheral frame 224 at the front side 210 of door frame 220. Lower outlet 264 may be defined directly below interactive display 200 such that at least a portion of the airflow 254 motivated by axial fans 256 may be directed from air inlet 250 to the ambient environment in front of door assembly 170 through lower outlet 264.

An airflow curtain path 266 is generally defined by lower outlet 264. In particular, airflow curtain path 266 may extend outward (e.g., in the transverse direction T) from door assembly 170 in front of image monitor 230. Thus, air exhausted through lower outlet 264 is projected from door assembly 170 along airflow curtain path 266, forming a curtain or blade of fast-moving air in front of door assembly 170 (i.e., forward from image monitor 230 along the transverse direction T). In certain embodiments, airflow curtain path 266 is defined to have a positive airflow angle between −45° and 45° with respect to (i.e., relative to) the transverse direction T (e.g., in a direction generally parallel to or away from cooktop appliance 104—FIG. 1). In some embodiments, the airflow angle is between 15° and 45° relative to transverse direction T. In other embodiments, the airflow angle is between −15° and 15°. In still other embodiments, the airflow angle is between −15° and −45° relative to transverse direction T. Thus, airflow curtain path 266 (and its associated curtain of air) extends from door assembly 170 or peripheral frame 224 along the airflow angle.

During use, heat, steam, or exhaust fumes (e.g., as represented by arrows 194) generated at cooktop appliance 104 (or another location directly beneath lower outlet 264) may be advantageously blocked or restricted by the mass of air flowing along airflow curtain path 266. In turn, the visibility at imaging surface 234 may be preserved, while further protecting various electronic components (e.g., such as image monitor 230 or controller 130—FIG. 2) of microwave appliance 102 from damage that may be caused by heat, steam, or exhaust fumes 194.

Figure 5:
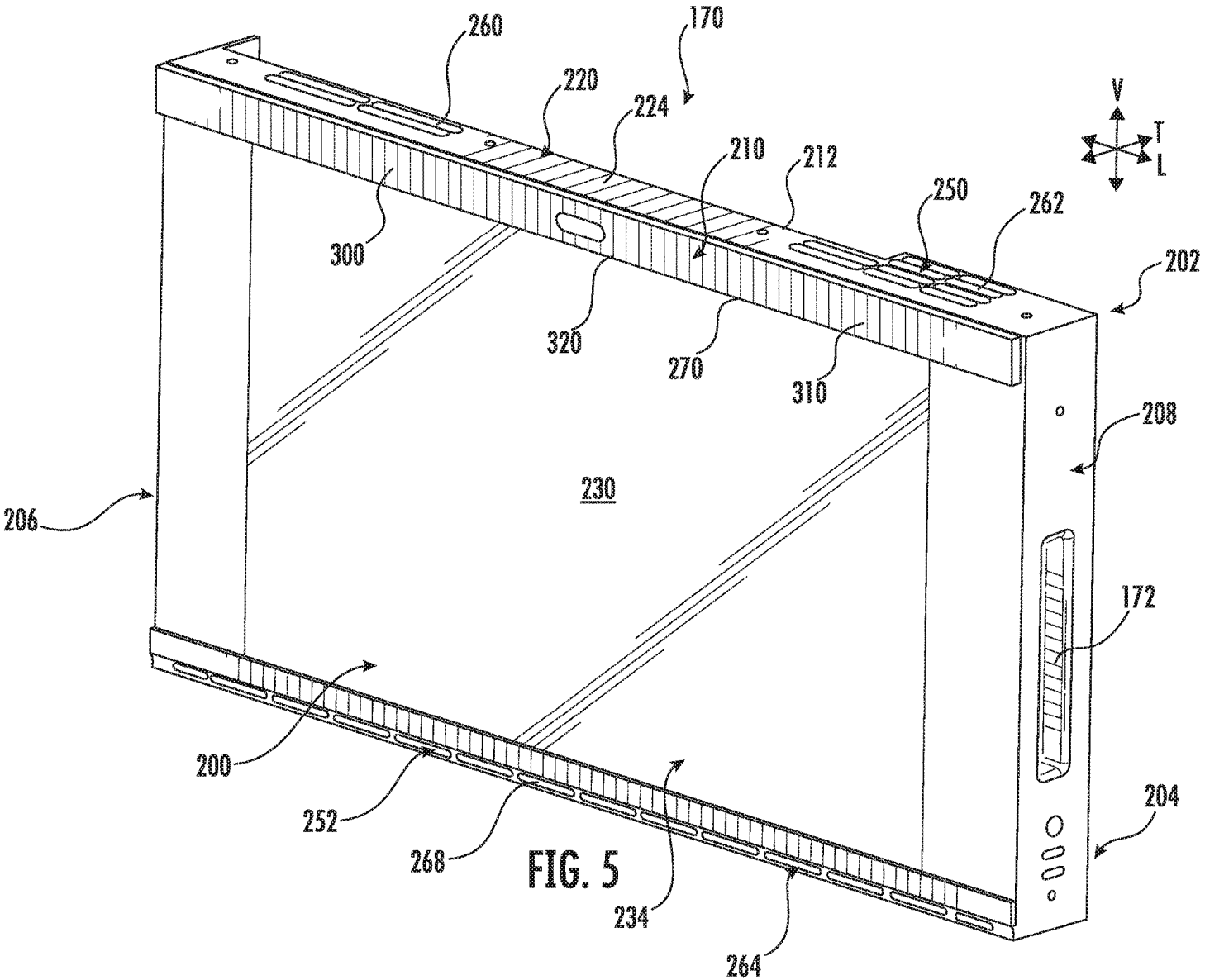
FIG. 5 provides a perspective view of a door assembly of the exemplary microwave appliance of FIG. 1 according to exemplary embodiments of the present disclosure.

As best shown in FIGS. 4 and 5, one or more bottom guide vanes 268 may be provided within lower outlet 264. In particular, each bottom guide vane 268 may extend along the vertical direction V from a top to a bottom of lower outlet 264. In certain embodiments, multiple vanes of a plurality of bottom guide vanes 268 are spaced apart along the lateral direction L. As air is motivated to lower outlet 264, the plurality of bottom guide vanes 268 may further direct the air (e.g., along the airflow curtain path 266) outward and away from door assembly 170.

According to exemplary embodiments, air outlets 252 may further include an upper outlet 270 that is defined through door assembly 170. For instance, upper outlet 270 may be defined through at least a portion of peripheral frame 224 proximal to the top end 202. In particular, upper outlet 270 may be directed downward at the front side 210 of door assembly 170 forward from image monitor 230. Along with being positioned forward from image monitor 230, upper outlet 270 may be positioned above image monitor 230. As illustrated, upper outlet 270 may define a coolant airflow path 272 along image monitor 230 (e.g., and imaging surface 234). Coolant airflow path 272 may extend from a position above image monitor 230 and therealong. Thus, at least a portion of the airflow motivated by air handler (e.g. axial fans 256) may be directed from air inlets 250, through low-pressure region 242 into high pressure region 244, and out both lower outlet 264 and upper outlet 270. Optionally, coolant airflow path 272 may be defined parallel to image monitor 230, slightly nonparallel to image monitor 230, or otherwise at a nonparallel angle relative to the airflow angle of the airflow curtain path 266. Advantageously, the coolant airflow path 272 may draw heat from door assembly 170 (e.g., at image monitor 230 or imaging surface 234) and further prevent gas, fumes, or moisture from accumulating on image monitor 230.

Figure 6:
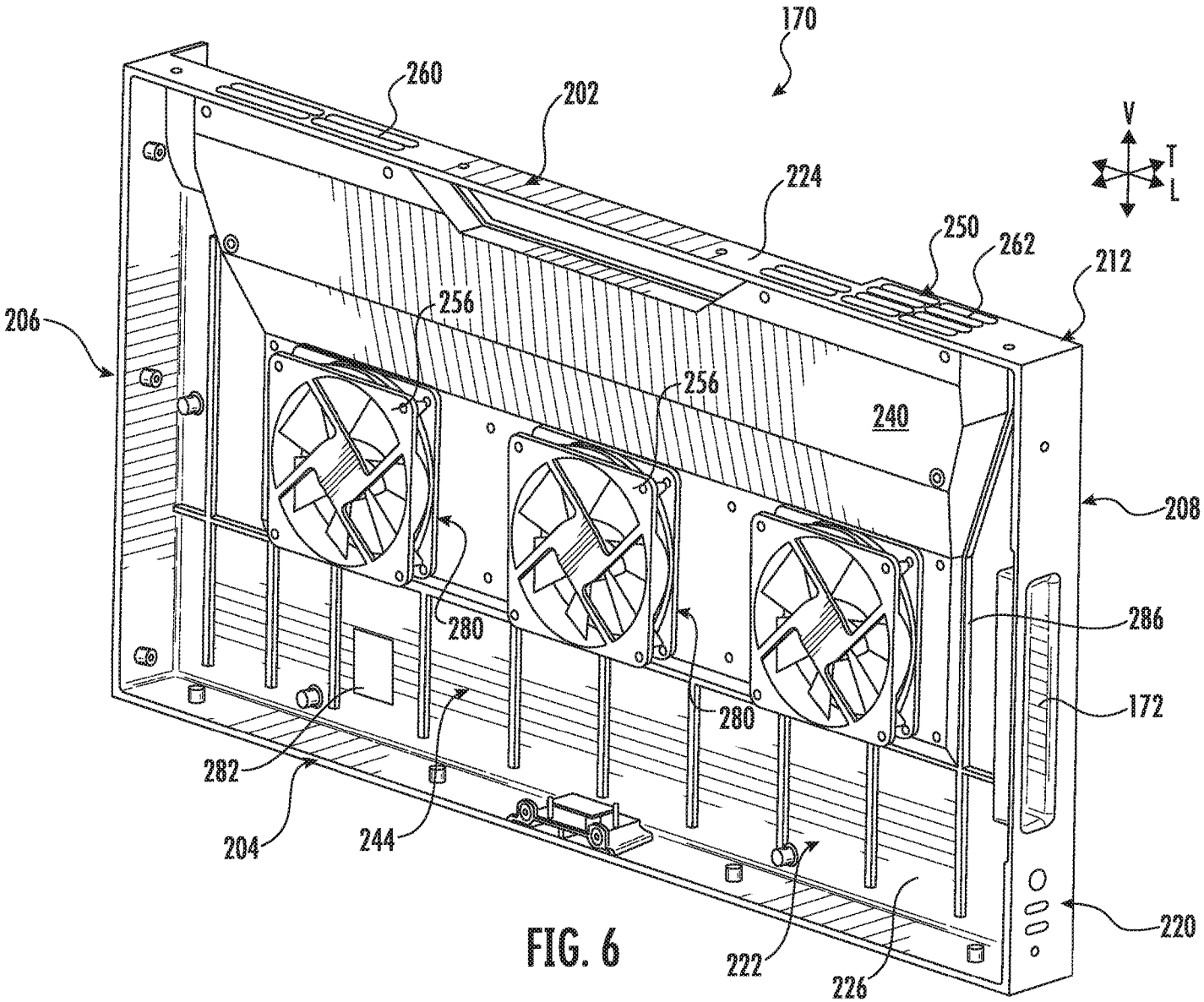
FIG. 6 provides a perspective view of the exemplary door assembly of FIG. 5 according to exemplary embodiments of the present disclosure, with an image monitor and a monitor cradle removed to reveal interior components of the door assembly.
Figure 7:
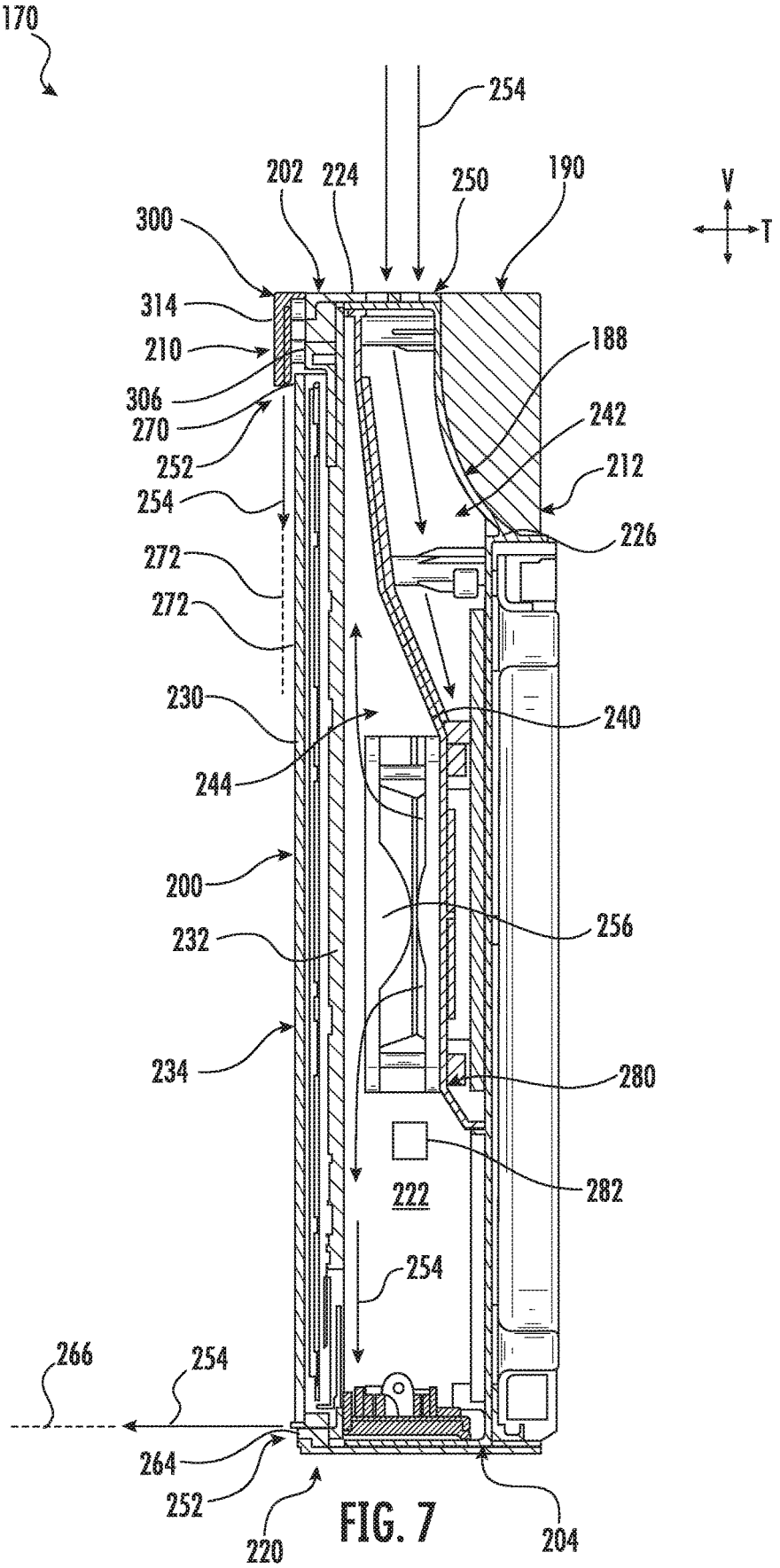
FIG. 7 provides a side cross-sectional view of the exemplary door of FIG. 5 according to exemplary embodiments of the present disclosure.

Referring now briefly to FIGS. 6 and 7, duct 240 and axial fans 256 will be described in more detail according to exemplary embodiments the present subject matter. Specifically, although any suitable number, position, and configuration of air handlers may be used, according to the illustrated embodiment, door assembly 170 includes a plurality of air handlers, e.g., three axial fans 256 that are spaced apart along the lateral direction L and are mounted within fan apertures 280 defined in duct 240. In addition, each of the axial fans 256 are oriented for directing the flow of air 254 from the low-pressure region 242 into the high-pressure region 244 along the transverse direction T. In this manner, a larger axial fan 256 may be used while minimizing a thickness of door assembly 170. In addition, according to exemplary embodiments, airflow 254 may be directed along the back of monitor cradle 232 to cool image monitor 230 as well as various electronic components (identified herein generally by reference numeral 282) positioned within a high pressure region 244.

According to the illustrated embodiment, axial fans 256 are located approximately at a vertical midpoint between a top end 202 and a bottom end 204 of door assembly 170 or door frame 220. In this manner, the flow of air 254 is drawn down into low-pressure region 242 before being redirected along the transverse direction into high-pressure region 244. In addition, as best shown in FIG. 6, the flow of air 254 is only drawn from lateral sides of door frame 220, e.g., through first set of apertures 260 and second set of apertures 262. As explained above, this eliminates mixing between flow of air 254 and flow of the exhaust air 186.

According to the illustrated embodiment, door frame 220 may define a plurality of structural ribs 286. Specifically, as illustrated, structural ribs 286 are defined as extending along the transverse direction from rear frame 226. In order to provide a good fluid seal between duct 240 and door frame 220, duct 240 may be seated against structural ribs 286. In this manner, low-pressure region 242 may be fluidly isolated from high pressure region 244 except through fan apertures 280.

Referring now specifically to FIGS. 8 through 11, according to an exemplary embodiment of the present disclosure, door assembly 170 includes a trim piece 300 that is positioned at front side 210 and top end 202 of door assembly 170 for at least partially defining upper outlet 270 and directing the flow of air 254 along the coolant airflow path 272. Specifically, according to the illustrated embodiment, trim piece 300 is detachable, or removably mounted to a top of the door frame 220 and extends downward along the vertical direction V in front of image monitor 230. Although an exemplary trim piece 300 and method of attached are described herein, it should be appreciated that variations and modifications to trim piece 300 and door assembly 170 may be made while remaining within the scope of the present subject matter.

Notably, as explained above, trim piece 300 is detachable and/or separate from the remainder of door frame 220. As a result, trim piece 300 facilitates simplified assembly of door assembly 170. In this regard, for example, a technician may first assemble door frame 220, duct 240, axial fans 256, and other electronic components 282 positioned within high-pressure region 244. Then, the interactive display 200 can be mounted directly to the door frame, e.g., by mechanical fasteners passing through a back side of monitor cradle 232, by snap-fit mechanisms, interference fit components, etc. After interactive display 200 is installed, trim piece 300 may be mounted to the door frame 220 at least partially in front of image monitor 230. Notably, attaching trim piece 300 after interactive display 200 is installed eliminates potential interference between trim piece 300 and interactive display 200 to simplify assembly. In addition, having a detachable trim piece 300 further facilitates the use of an interactive display that extends nearly the entire height and width of door assembly 170 for a cleaner look to the consumer.

Figure 10:
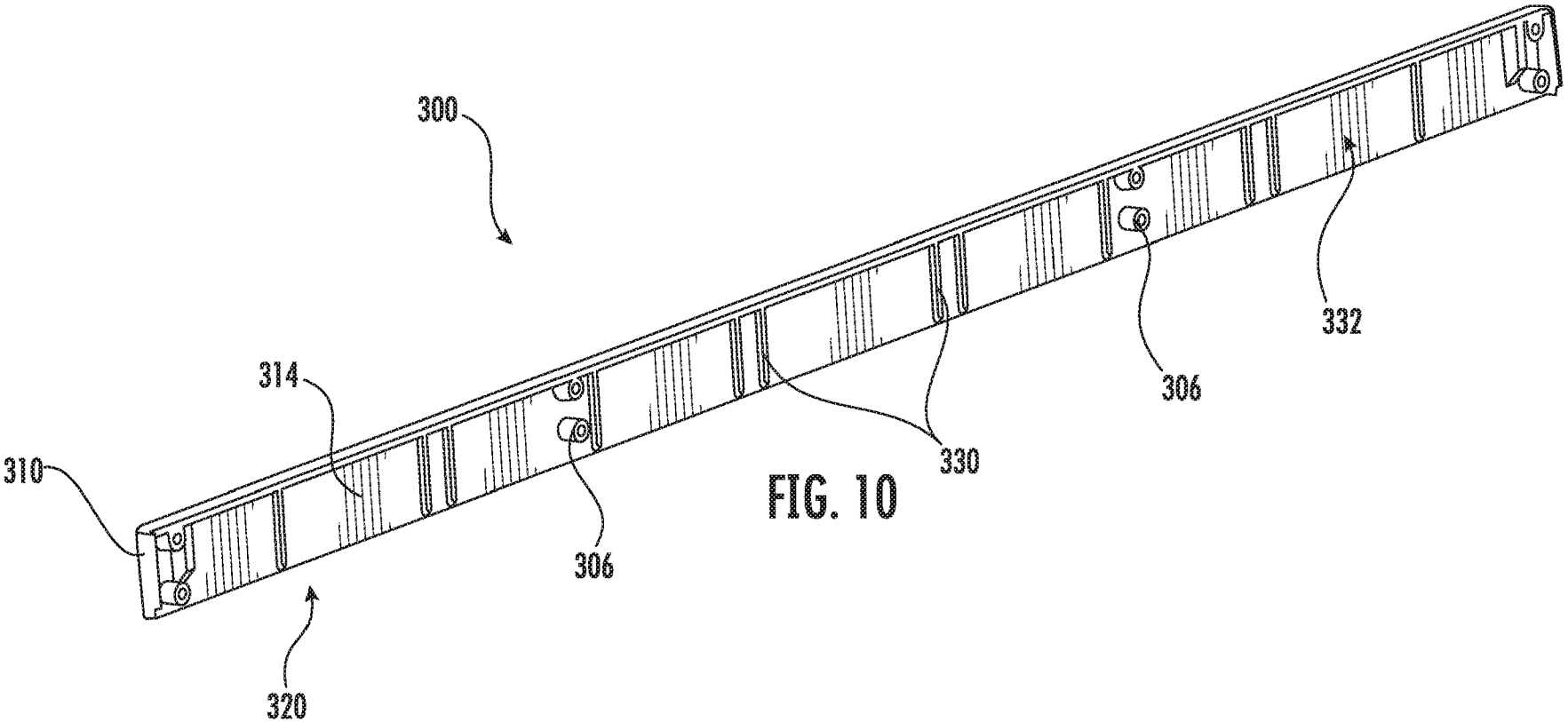
FIG. 10 provides a rear perspective view of a trim piece of the exemplary door assembly of FIG. 5 according to exemplary embodiments of the present disclosure.
Figure 11:
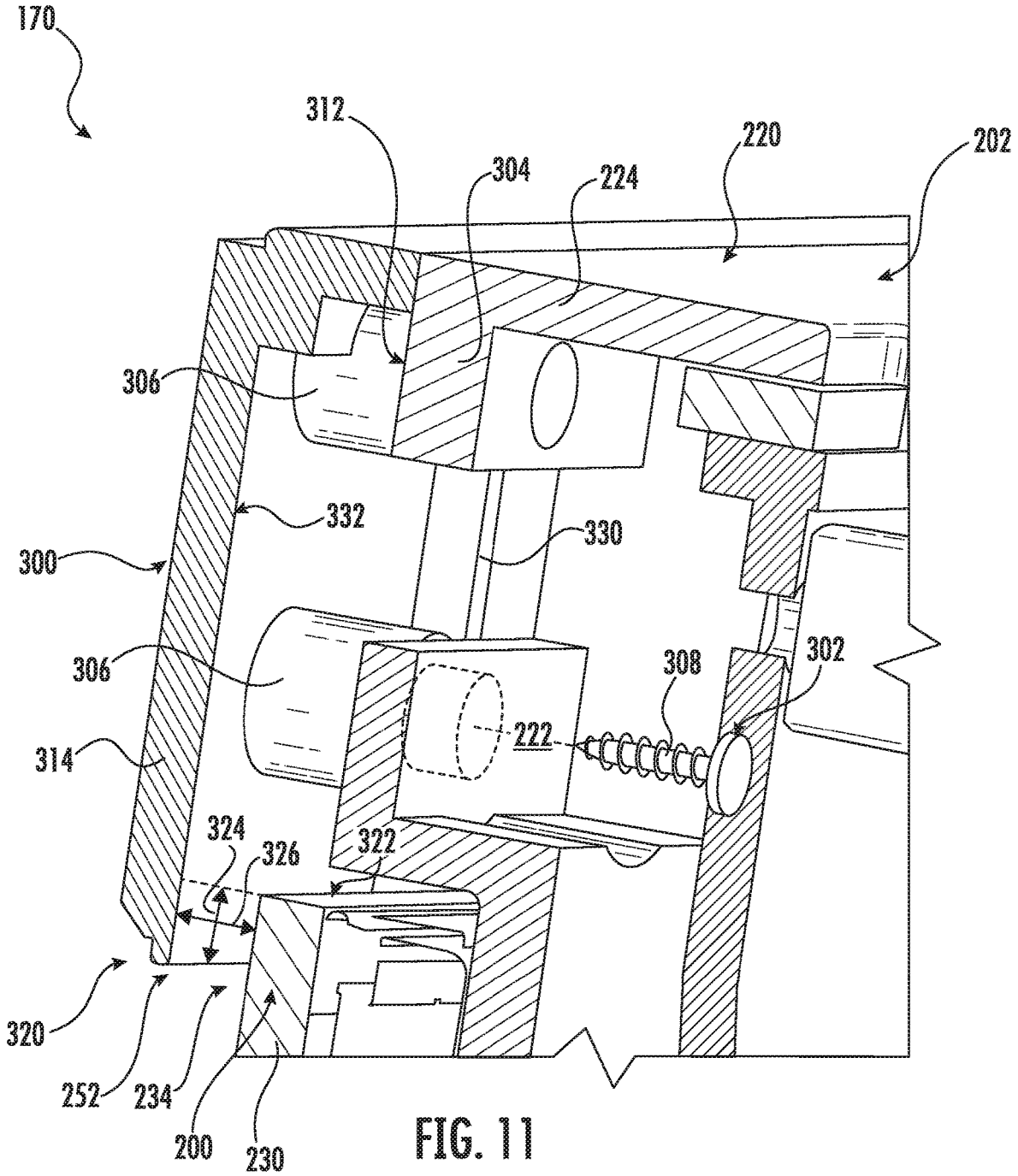
FIG. 11 provides another cross-sectional view of the exemplary door assembly of FIG. 5 according to exemplary embodiments of the present disclosure.

In general, trim piece 300 may be mounted to door frame 220 in any suitable manner. According to an exemplary embodiment, trim piece 300 is attached over image monitor 230 using one or more mechanical fasteners 302. Specifically, as best shown in FIGS. 10 and 11, door frame 220 includes a plurality of laterally spaced mounting brackets 304 that extend downward from a top of peripheral frame 224. In addition, trim piece 300 defines a plurality of mounting bosses 306 that are configured for receiving the mechanical fasteners 302 (e.g., threaded screws 308). To attach trim piece 300, mechanical fasteners 302 may be passed through the back sides of mounting brackets 304 and into mounting bosses 306 to secure trim piece 300 in place. According to alternative embodiments, fasteners 302 may pass from a front of trim piece 300, through mounting bosses 306, and may be secured to mounting brackets 304. According to such an embodiment, an appearance panel 310 (e.g., a stainless steel or otherwise finished panel, see FIG. 8) may snap onto or be glued onto trim piece 300 for an improved appearance. It should be appreciated that other means for attaching trim piece 300 are possible and within the scope of the present subject matter.

Once installed, mounting bosses 306 are securely seated against a front surface 312 of mounting brackets 304 or peripheral frame 224 such that upper outlet 270 is properly positioned and formed in front of interactive display 200. In this regard, for example, trim piece 300 includes a front guide 314 that is spaced apart from image monitor 230 along the transverse direction T to define upper outlet 270 when trim piece 300 is installed. Thus, front guide 314 directs the flow of air 254 downward along the vertical direction V in front of image monitor 230 (e.g., described above as the coolant airflow path). Notably, this flow of air 254 along the coolant airflow path 272 maintains a desired temperature of imaging surface 234, internal components of image monitor 230, etc.

Figure 8:
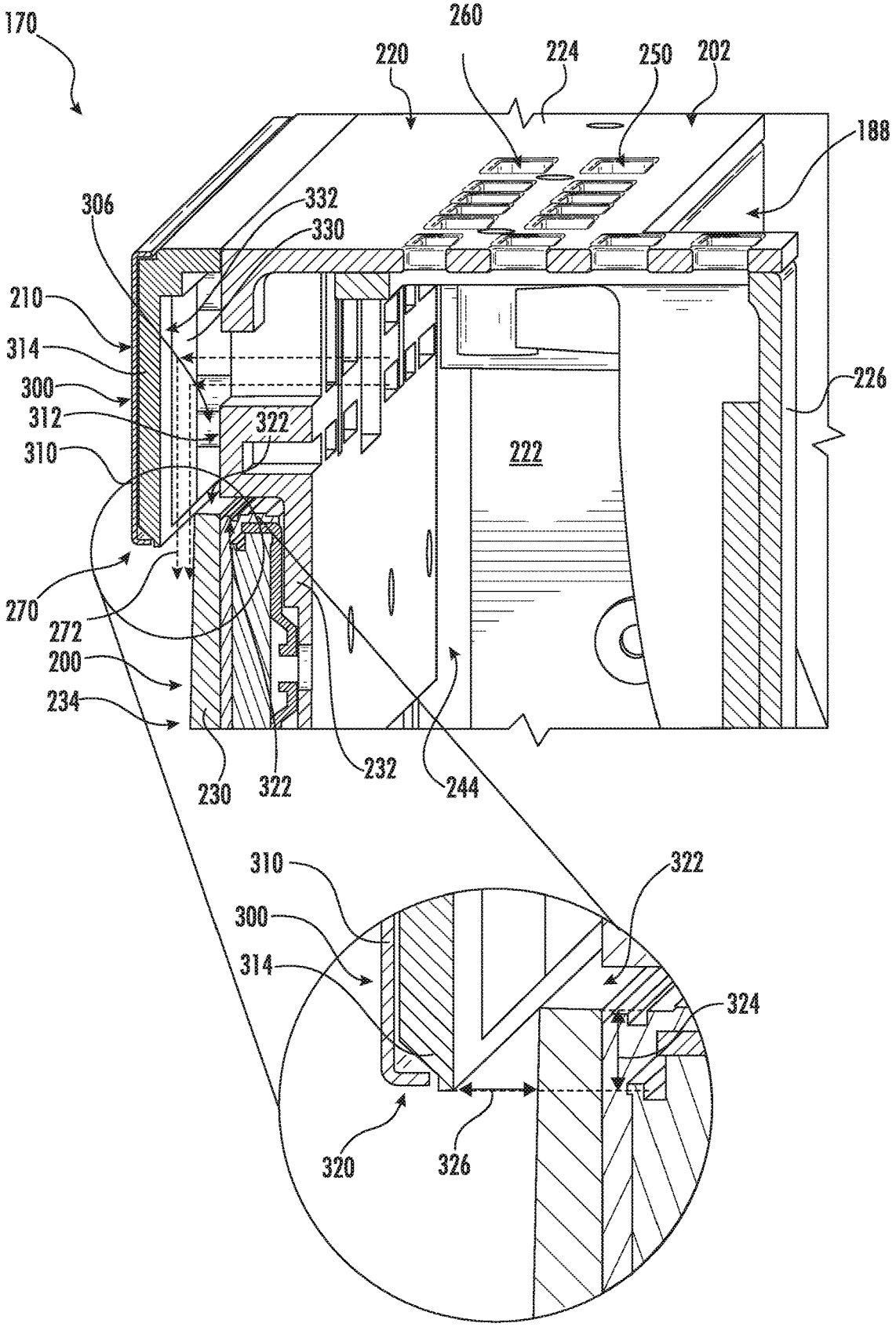
FIG. 8 provides another cross-sectional view of the exemplary door assembly of FIG. 5 according to exemplary embodiments of the present disclosure.
Figure 9:
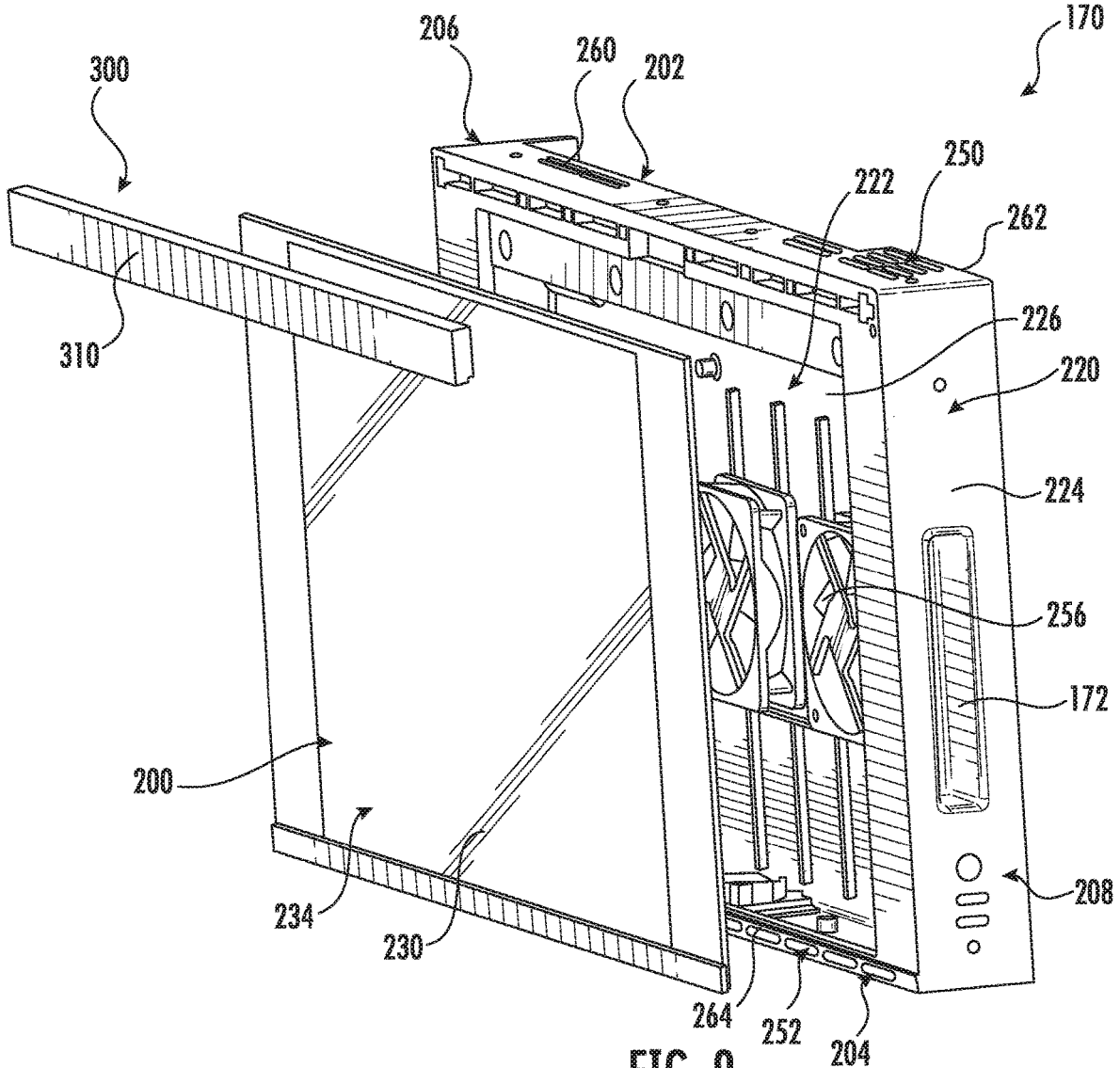
FIG. 9 provides an exploded view of the exemplary door assembly of FIG. 5 according to exemplary embodiments of the present disclosure.

The geometry, size, and position of trim piece 300 may vary in order to adjust the upper outlet 270 as needed for a given application. For example, according to the exemplary embodiment, a distal end or bottom end 320 of front guide 314 extends below a top end 322 of image monitor 230 along the vertical direction V. For example, as best shown in FIGS. 8 and 11, bottom end 320 is positioned below top end 322 by an overlap distance 324. In addition, front guide 314 may be spaced apart from imaging surface 234 by an outlet width 326 defined along the transverse direction T. According to an exemplary embodiment, the overlap distance 324 is greater than the outlet width 326, e.g., to facilitate development of the coolant airflow path 272 that directs the flow of air 254 along imaging surface 234. According to still other embodiments, overlap distance 324 may be less than outlet width 326, or these two distances may substantially equivalent.

Furthermore, as illustrated, upper outlet 270 is defined between a first end and a second end of the trim piece 300 (e.g., equivalent to first side 206 and second side 208 of door assembly 170) along the lateral direction L. In this manner, the flow of air 254 passes along an entire width of image monitor 230. In addition, trim piece 300 may further include features for directing the flow of air 256 and developing coolant flow path 272. For example, as best illustrated in FIGS. 10 and 11, trim piece 300 further includes a plurality of guide fins 330 defined on a rear side 332 of front guide 314 for directing the flow of air 254. According to the illustrated embodiment, guide fins 330 extend substantially along the vertical direction V and are spaced apart along the lateral direction L. In addition, guide fins 330 may define a depth that is less than outlet width 326 or substantially equivalent to outlet width 326. In this manner, trim piece 300 simplifies assembly of door assembly 170 while ensuring a suitable flow of cooling air 254 is directed along imaging surface 234 to facilitate improved operation, reliability, and consumer satisfaction of interactive display 200 and system 100. In addition to directing the flow of air 254, it should be appreciated that according to exemplary embodiments, guide fins 330 may also provide structural rigidity to trim piece 300.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A microwave appliance mountable over a cooktop appliance, the microwave appliance defining a vertical direction, a lateral direction, and a transverse direction, the microwave appliance comprising:

a cabinet defining a cooking chamber; and a door assembly rotatably mounted to the cabinet for providing selective access to the cooking chamber, the door assembly comprising:

a door frame defining a door plenum and an air inlet;

a monitor cradle mounted to a front of the door frame;

an image monitor mounted within the monitor cradle;

an air handler positioned within the door frame for urging a flow of air through the door plenum; and a trim piece removably mounted to a top of the door frame, wherein the trim piece comprises a front guide that is spaced apart from the image monitor along the transverse direction to define an upper outlet that directs the flow of air downward along the vertical direction in front of the image monitor, wherein the trim piece further comprises a plurality of guide fins defined on a rear side of the front guide for directing the flow of air directly through the upper outlet, wherein a bottom end of the front guide extends below a top end of the image monitor along the vertical direction and the front guide is spaced apart from the image monitor by an outlet width and the bottom end of the front guide overlaps the top end of the image monitor by an overlap distance, wherein the overlap distance is greater than the outlet width.

2. The microwave appliance of claim 1, wherein the upper outlet is defined between a first end and a second end of the trim piece along the lateral direction.

3. The microwave appliance of claim 1, wherein each of the plurality of guide fins extend along the vertical direction.

4. The microwave appliance of claim 1, wherein the trim piece is attached over the image monitor using one or more mechanical fasteners.

5. The microwave appliance of claim 4, wherein the one or more mechanical fasteners comprises a plurality of screws that pass through the door frame and into a plurality of bosses defined in the trim piece.

6. The microwave appliance of claim 1, wherein the door frame further defines a lower outlet.

7. The microwave appliance of claim 6, wherein the door assembly further comprises:

a duct mounted to the door frame and dividing the door plenum into a low pressure region and a high pressure region.

8. The microwave appliance of claim 7, wherein the flow of air is drawn in through the air inlet into the low pressure region and is then discharged into the high pressure region and out of the lower outlet along the lateral direction and out of the upper outlet along the vertical direction.

9. The microwave appliance of claim 6, wherein the image monitor is supported on the door frame above the lower outlet and below the upper outlet.

10. The microwave appliance of claim 1, wherein a front surface of the image monitor sits on top of or flush with the door frame along the transverse direction.

11. The microwave appliance of claim 1, wherein the door frame extends in the vertical direction from a top end to a bottom end, and wherein the air inlet is defined through the door frame proximal to the top end.

12. The microwave appliance of claim 1, wherein the air handler comprises:

a plurality of axial fans spaced apart along the lateral direction and oriented for directing the flow of air along the transverse direction.

13. A door assembly for a microwave appliance, the microwave appliance being mountable over a cooktop appliance and comprising a cabinet defining a cooking chamber, the door assembly comprising:

a door frame defining a door plenum and an air inlet;

a monitor cradle mounted to a front of the door frame;

an image monitor mounted within the monitor cradle;

an air handler positioned within the door frame for urging a flow of air through the door plenum; and a trim piece removably mounted to a top of the door frame, wherein the trim piece comprises a front guide that is spaced apart from the image monitor along the transverse direction to define an upper outlet that directs the flow of air downward along the vertical direction in front of the image monitor, wherein the trim piece further comprises a plurality of guide fins defined on a rear side of the front guide for directing the flow of air directly through the upper outlet, wherein a bottom end of the front guide extends below a top end of the image monitor along the vertical direction and the front guide is spaced apart from the image monitor by an outlet width and the bottom end of the front guide overlaps the top end of the image monitor by an overlap distance, wherein the overlap distance is greater than the outlet width.

14. The door assembly of claim 13, wherein the door assembly further comprises:

a duct mounted to the door frame and dividing the door plenum into a low pressure region and a high pressure region, wherein the flow of air is drawn in through the air inlet into the low pressure region and is then discharged into the high pressure region and out of the lower outlet along the lateral direction and out of the upper outlet along the vertical direction.

15. The microwave appliance of claim 1, wherein the guide fins define a depth that is substantially equivalent to an outlet width of the upper outlet.

16. The door assembly of claim 13, wherein the guide fins define a depth that is substantially equivalent to an outlet width of the upper outlet.

17. The microwave appliance of claim 12, wherein the plurality of axial fans are located approximately at a vertical midpoint between a top end and a bottom end of the door plenum.

* * * * *